US006929559B1

(12) United States Patent
Grace

(10) Patent No.: US 6,929,559 B1
(45) **Date of Patent: *Aug. 16, 2005**

(54) HIGH MOMENT FOR INERTIA PUTTER HAVING THREE WEIGHTS

(75) Inventor: Robert M. Grace, St. Pete Beach, FL (US)

(73) Assignee: MacGregor Golf Company, Albany, GA (US)

( * ) Notice: Subject to any disclaimer, the term of this patent is extended or adjusted under 35 U.S.C. 154(b) by 47 days.

This patent is subject to a terminal disclaimer.

(21) Appl. No.: 10/250,070

(22) Filed: Jun. 2, 2003

Related U.S. Application Data

(63) Continuation-in-part of application No. 10/248,342, filed on Jan. 10, 2003.

(51) Int. Cl.[7] ..... A63B 69/36; A63B 53/04

(52) U.S. Cl. ..... 473/251; 473/334; 473/340; 473/349

(58) Field of Search ..... 473/324, 340, 473/341, 349, 334, 335, 336, 337, 338, 339, 291, 244, 251

(56) References Cited

U.S. PATENT DOCUMENTS

| | | | | | |
|---|---|---|---|---|---|
| 1,901,562 | A | * | 3/1933 | Main | 473/330 |
| 3,042,405 | A | * | 7/1962 | Solheim | 473/313 |
| 3,143,349 | A | * | 8/1964 | MacIntyre | 473/338 |
| 3,770,279 | A | * | 11/1973 | Phinny | 473/313 |
| 3,966,210 | A | * | 6/1976 | Rozmus | 473/341 |
| 4,010,958 | A | * | 3/1977 | Long | 473/341 |
| 4,898,387 | A | * | 2/1990 | Finney | 473/341 |
| 5,058,895 | A | * | 10/1991 | Igarashi | 473/341 |
| 5,620,379 | A | * | 4/1997 | Borys | 473/313 |
| 5,630,765 | A | * | 5/1997 | Moore | 473/252 |
| 5,685,784 | A | * | 11/1997 | Butler | 473/340 |
| 5,830,078 | A | * | 11/1998 | McMahan | 473/252 |
| 5,871,407 | A | * | 2/1999 | Tseng | 473/328 |
| 6,059,669 | A | * | 5/2000 | Pearce | 473/339 |
| 6,080,070 | A | * | 6/2000 | Whitley | 473/340 |
| 6,471,600 | B2 | * | 10/2002 | Tang et al. | 473/242 |

* cited by examiner

*Primary Examiner*—Sebastiano Passaniti
(74) *Attorney, Agent, or Firm*—Burns, Doane, Swecker & Mathis, L.L.P.

(57) ABSTRACT

A golf putter head of triangular shape. A ball-striking leading wall has a first breadth greater than a second breadth of a trailing wall. The leading and trailing walls are interconnected at their respective opposite ends by sidewalls that converge toward one another and define a cavity of trapezoidal shape. The center of gravity of the golf putter head is closer to the trailing wall than the leading wall to provide a moment of inertia that reduces the effects of missing a sweet spot on the leading wall during a putt. In one embodiment, the trailing wall is weighted to move the center of gravity closer to the trailing wall. In another embodiment, a web interconnects the leading and trailing walls along a longitudinal axis of the golf putter head. Another embodiment adds a pair of weights to the leading end of each sidewall, significantly increasing the moment of inertia.

21 Claims, 5 Drawing Sheets

HIGH MOMENT FOR INERTIA PUTTER HAVING THREE WEIGHTS

CROSS-REFERENCE TO RELATED DISCLOSURE

This disclosure is a continuation-in-part of application Ser. No. 10/248,342, filed Jan. 10, 2003, by the same inventor, entitled "High Moment Of Inertia Putter."

BACKGROUND OF THE INVENTION

1. Field of the Invention

This invention relates, generally, to golf putters. More particularly, it relates to a golf putter of generally triangular configuration having a high moment of inertia.

2. Description of the Prior Art

In a perfect putt, the golfer strikes the ball exactly on the sweet spot of the putter head. This prevents the putter head from twisting about the axis defined by the golf club shaft. However, when the sweet spot is missed, the inertia offered by the ball imparts a torque to the golf club shaft. The torque increases in direct proportion to the distance by which the sweet spot is missed.

A putter head having a high moment of inertia resists the torque caused by missing the sweet spot. Putter heads having high moments of inertia are typically very wide and have weights attached to their outermost points. Most golfers prefer to play, however, with normal-sized, attractive putter heads rather than obviously over-sized putter heads.

Accordingly, there is a need for an attractive golf club putter head having a substantially normal width or breadth that provides a very high moment of inertia.

However, in view of the prior art considered as a whole at the time the present invention was made, it was not obvious to those of ordinary skill in the pertinent art how such need could be fulfilled.

SUMMARY OF INVENTION

The long-standing but heretofore unfulfilled need for a golf putter head of acceptable size that provides a high moment of inertia is now met by a new, useful, and nonobvious invention. The novel golf putter head includes a main body having a generally triangular configuration. A leading wall of the main body has a first breadth, a top edge and a bottom edge. A trailing wall of the main body has a second breadth less than said first breadth, a top edge, and a bottom edge.

A first sidewall interconnects a first end of the leading wall and a first end of the trailing wall. A second sidewall interconnects a second end of the leading wall and a second end of the trailing wall.

A soleplate interconnects the bottom edge of the leading wall and the bottom edge of the trailing wall. The soleplate has a breadth less than the breadth of the trailing wall. The soleplate is normal to the leading wall and the trailing wall and has a length greater than the breadth of the leading wall.

A cavity is formed in the main body, bounded on four sides by the leading wall, the trailing wall, the first sidewall, and the second sidewall. The cavity is unbounded on a top end and is partially bounded on a lower end by the soleplate.

The trailing wall is spaced in trailing relation to the leading wall by a sufficient distance to position a center of gravity of the putter head about two-thirds of the way between the leading wall and the trailing wall. Accordingly, the center of gravity is closer to the trailing wall than to the leading wall. Such positioning of the center of gravity provides an enhanced moment of inertia to minimize the effects of a putt that misses a sweet spot on a ball-striking surface that is adapted to be mounted to the leading wall.

A first weight-receiving cavity is formed in a trailing part of the putter head. The trailing part of the putter head is defined as the part between the trailing wall of the putter head and the respective trailing ends of the cavity.

A first weight means is positioned within the first weight-receiving cavity to further enhance the moment of inertia by positioning the center of gravity further away from the leading wall and closer to the trailing wall.

An upstanding web is disposed in interconnecting relation between the leading wall and the trailing wall. The web is disposed normal to the leading wall and the trailing wall. The cavity is therefore divided into two cavities by the web. Thus, the web transmits forces applied to the leading wall at least in part to the trailing wall so that resistance offered by the trailing wall supplements resistance offered by the leading wall to the applied forces.

The soleplate is centered on a longitudinal axis of symmetry of the golf putter head and the web is mounted in upstanding relation to the soleplate. More particularly, the web is disposed on the longitudinal axis of the golf putter head and divides the cavity into two cavities of equal size.

A second weight-receiving cavity is formed in the first sidewall, just rearwardly of the leading wall, and a third weight-receiving cavity is formed in the second sidewall, just rearwardly of the leading wall.

A second weight, of about ten (10) grams, is positioned within the second weight-receiving cavity and a third weight, also of about ten (10) grams, is positioned within the third weight-receiving cavity.

The second and third weights move the center of gravity forwardly a small amount, but the center of gravity remains closer to the trailing wall than to the leading wall. Significantly, the moment of inertia of the putter head is significantly increased.

An important object of this invention is to provide a golf putter head having a moment of inertia greater than 6,000 gm cmÂ$^2$. A closely related object is to accomplish the foregoing object in a putter head that is light-in-weight and inexpensive to manufacture.

Another important object is to provide a high moment of inertia putter head having an acceptable, aesthetically-pleasing size.

These and other important objects, advantages, and features of the invention will become clear as this description proceeds.

The invention accordingly comprises the features of construction, combination of elements, and arrangement of parts that will be exemplified in the description set forth hereinafter and the scope of the invention will be indicated in the claims.

BRIEF DESCRIPTION OF DRAWINGS

For a fuller understanding of the nature and objects of the invention, reference should be made to the following detailed description, taken in connection with the accompanying drawings, in which.

DETAILED DESCRIPTION

Figure 1:
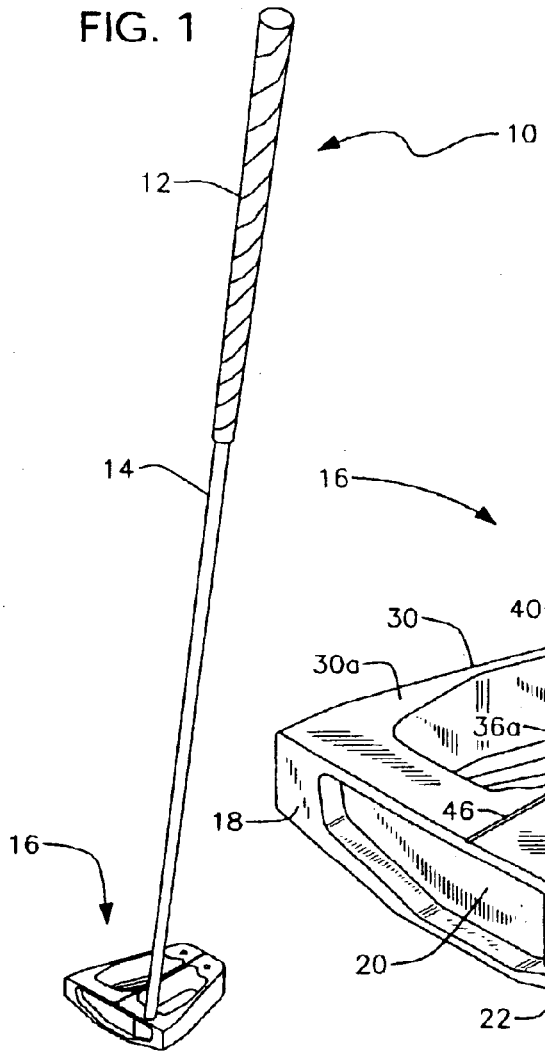
FIG. 1 is a perspective view of a putter equipped with the novel putter head.

Referring to FIG. 1, it will there be seen that the reference numeral 10 denotes an illustrative embodiment of the present invention as a whole.

Golf putter 10, includes grip 12, shaft 14, and novel putter head 16.

Figure 2:
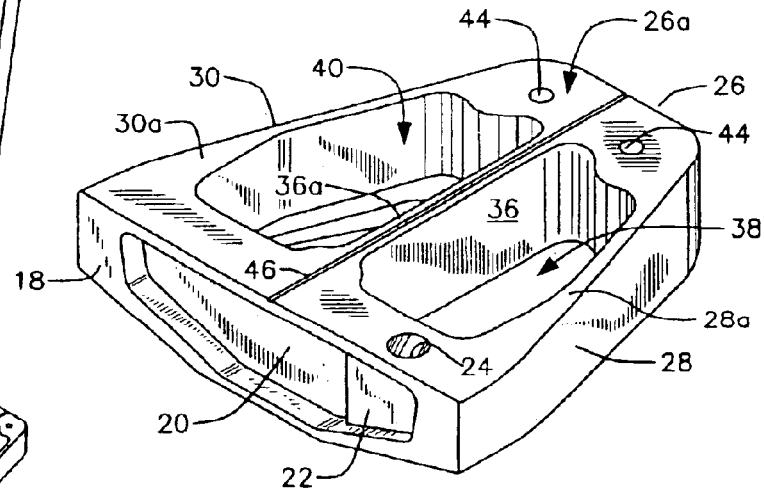
FIG. 2 is a perspective view of the novel putter head.
Figure 3:
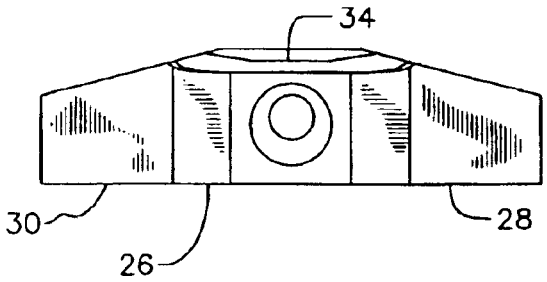
FIG. 3 is a rear elevational view thereof.

As best depicted in FIG. 2, novel putter head 16 includes transversely disposed leading wall 18 having recess 20 formed therein for receiving a ball-striking insert, not shown. Recess 20 has less depth at its right end 22 to provide increased structural support for the leading end of shaft 14, said leading end being received within blind bore 24.

In a preferred embodiment, the breadth of leading wall 18 is only four inches (4"). This distinguishes putter head 16 from any high moment of inertia putter head that relies upon a very wide, unaesthetic leading wall.

Golf putter head 16 further includes transversely disposed trailing wall 26 that is parallel with leading wall 18. The breadth, width, or transverse extent of leading wall 18 is greater than the breadth, width, or transverse extent of trailing wall 26.

As perhaps best understood by considering FIGS. 2–5 together, first sidewall 28 interconnects a first end of leading wall 18 and a first end of trailing wall 26. Second sidewall 30 interconnects a second end of leading wall 18 and a second end of trailing wall 26. Accordingly, sidewalls 28 and 30 converge toward one another from said leading wall to said trailing wall. As best indicated in the top plan view of FIG. 4, the novel structure creates a generally triangular-shaped putter head; more accurately, the shape is that of a trapezoid with rounded corners.

Note that the longitudinal extent from leading wall 18 to trailing wall 26 is greater than the transverse extent of said leading wall 18. It is also worth observing that trailing wall 26 is centered with respect to the sweet spot of the putter head, rearwardly thereof, and has a truncate breadth so that its opposite ends are positioned close to the longitudinal axis of symmetry of the putter head, it being understood that said sweet spot is centered on said longitudinal axis of symmetry.

Figure 4:
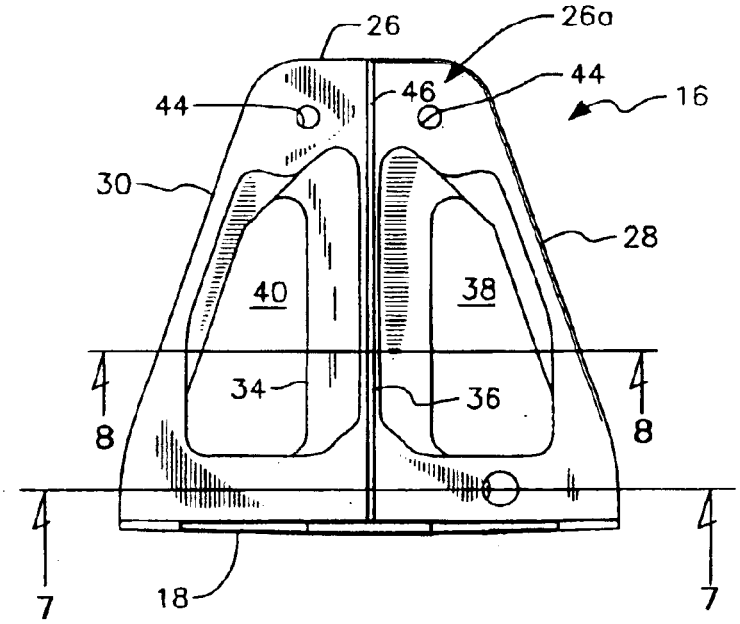
FIG. 4 is a top plan view thereof.
Figure 5:
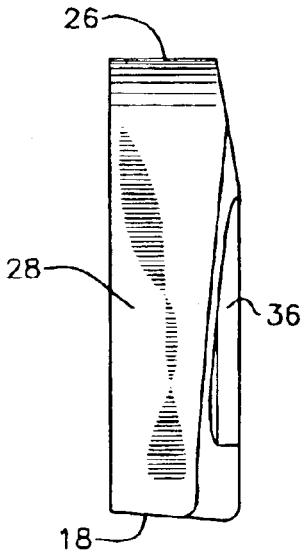
FIG. 5 is a side elevational view thereof.
Figure 6:
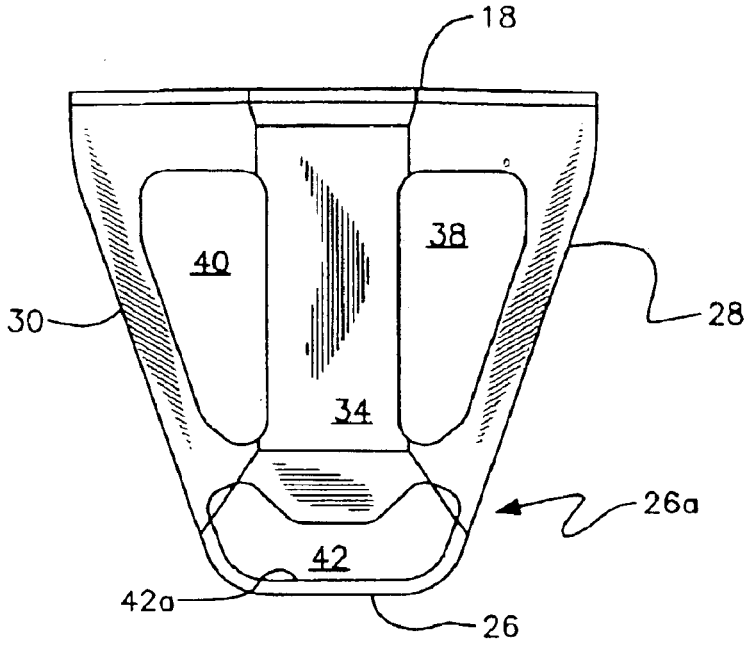
FIG. 6 is a bottom plan view thereof.
Figure 7:
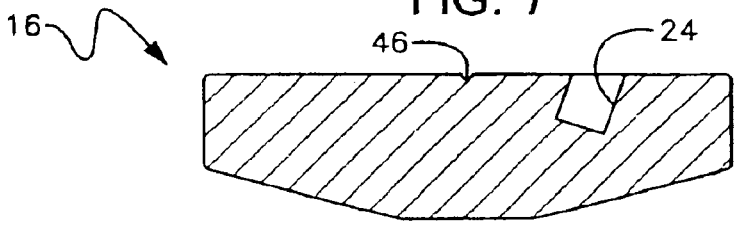
FIG. 7 is a transverse sectional view taken along line 7-7 in FIG. 4.
Figure 8:
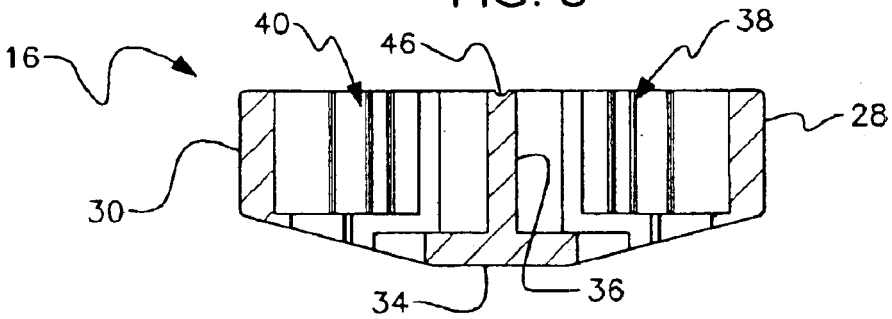
FIG. 8 is a transverse sectional view taken along line 8-8 in FIG. 4.

Soleplate 34, best seen in FIGS. 4 and 6, is disposed in interconnecting relation between leading wall 18 and trailing wall 26 and is centered with a longitudinal axis of symmetry of golf putter head 16. More particularly, soleplate 34 interconnects a bottom edge of leading wall 18 and a bottom edge of trailing wall 26. Forces applied to leading wall 18 are transmitted to trailing wall 26 by said soleplate and by sidewalls 28, 30 as well.

Upstanding web 36 is mounted on and projects upwardly from soleplate 34 and is coincident with the longitudinal axis of symmetry of putter head 16. Top edge 36*a* of web 36 is flush with top edge 28*a* of sidewall 28 and top edge 30*a* of sidewall 30.

With the exception of soleplate 34 and web 36, the space peripherally bounded by leading wall 18, trailing wall 26, and sidewalls 28, 30 is empty, i.e., putter head 16 is substantially of hollow construction. Thus it is understood that web 36 divides that hollow space into cavities 38 and 40. Cavities 38, 40 reduce the weight of putter head 16 and enable the center of gravity of said putter head to be positioned on the trailing side of leading wall 18.

Cavities 38, 40 do not extend all the way to trailing wall 26. Thus, a large part of the mass of putter head 16 is provided in trailing end 26*a* thereof, thereby positioning the center of gravity of putter head 16 in trailing relation to leading wall 16. This increases the moment of inertia of the putter head. If putter head 16 is made of a single material, such as stainless steel, the moment of inertia will still be high but will be less than a moment of inertia achieved by weighting said trailing end 26*a*.

The center of gravity is moved further from leading wall 18, and the moment of inertia thereby increased, by adding a first weight means to trailing end 26*a*. A weighted putter head represents the second embodiment of this invention. Such a weight means is denoted 42 in FIG. 6. Cavity 42*a* is milled into trailing end 26*a* to accommodate said weight means, and said weight means is flush with the top of cavity 42*a* when the weight means is secured therewithin by suitable fastening means such as fasteners 44, 44 (FIGS. 2 and 4).

Where weight means 42 is formed of copper, the moment of inertia of putter head 16 is approximately 5860 gm cmÂ$^2$. Where weight means 42 is formed of a 25/75 copper/tungsten mixture, the moment of inertia is about 6800 gm cmÂ$^2$, and where weight means 42 is formed of tungsten only, the moment of inertia is about 7355.

Where weight means 42 is formed of copper, the center of gravity of putter head 16 is positioned about 60% of the distance from leading wall 18 to trailing wall 26. Where weight means 42 is formed of a 25/75 copper/tungsten mixture, the center of gravity is positioned about 70% of the distance from leading wall 18 to trailing wall 26, and where weight means 42 is formed of tungsten only, the center of gravity is positioned about 78% of the distance from leading wall 18 to trailing wall 26Groove 46 is formed in the top of putter head 26 and extends from the top edge of leading wall 18 to the top edge of trailing wall 26, along the top edge of web 36. Said groove 46 thus is coincident with a longitudinal axis of putter head 16 and provides a sighting line that a golfer may use when lining up a putt.

Figure 9:
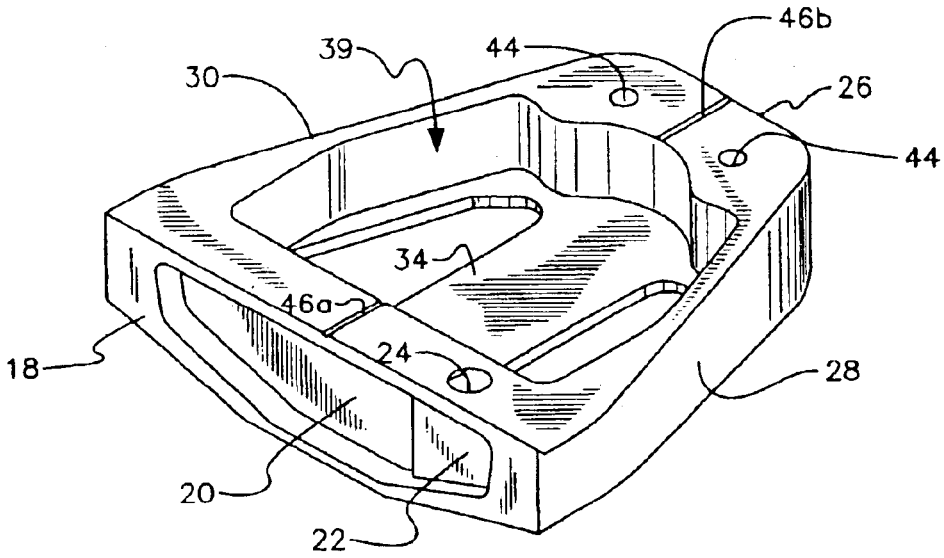
FIG. 9 is a top perspective view of a second embodiment.
Figure 10:
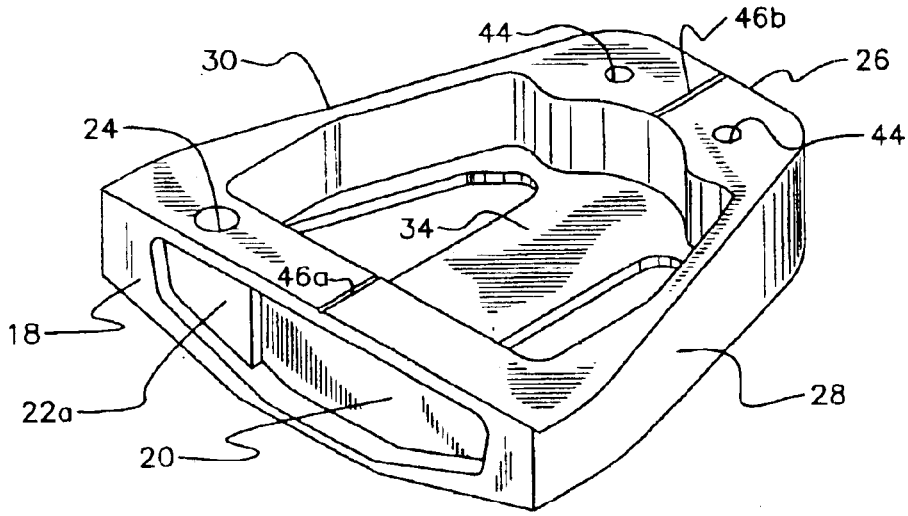
FIG. 10 is a top perspective view of a putter head for a left-handed golfer.

In FIGS. 9 and 10, web 36 is obviated and a single cavity 39 is thereby provided. Thus, groove 46 is broken up into truncate leading part 46*a* and truncate trailing part 46*b*, but said truncate parts still collectively provide a sighting line that a golfer can use when lining up a putt.

The elimination of web 36 moves the center of gravity still further to the trailing side of leading wall 18, relative to the first two embodiments, and the moment of inertia may therefore be increased further still, depending upon whether a weight means is added to trailing part 26*a* as in the second embodiment hereof.

FIG. 10 also indicates that strengthening insert 22*a* is moved to an opposite end of recess 20 for a left-handed golfer, and that blind bore 24 is re-positioned as well.

Figure 11:
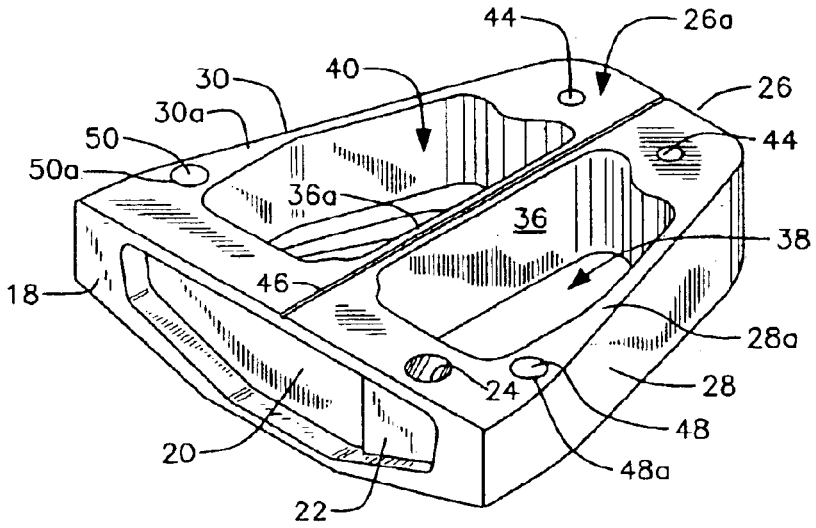
FIG. 11 is a top perspective view of an embodiment having three weights.

FIG. 11 depicts a second weight-receiving cavity 48*a* is formed in first sidewall 28, just rearwardly of leading wall 18, and a third weight-receiving cavity 50*a* is formed in second sidewall 30, just rearwardly of leading wall 18. A second weight 48, of about ten (10) grams, is positioned within second weight-receiving cavity 48*a* and a third weight 50, also of about ten (10) grams, is positioned within third weight-receiving cavity 50*a*. The second and third weights move the center of gravity forwardly a small amount, but the center of gravity remains closer to the trailing wall than to the leading wall. Significantly, the moment of inertia of the putter head is significantly increased. Where second and third weight means 48, 50 are formed of copper/tungsten, the moment of inertia of putter head 16 is approximately 6400 gm cmÂ$^2$.

This very high moments of inertia achieved by these embodiments of the inventive putter head have never before been achieved in a golf putter having a leading wall that is only four inches (4") in breadth or in a golf putter head that weighs under 350 grams or in a putter head of such an acceptable size.

This technology is to be known commercially as Tri-Weighted Technologyâ▽. If all three weights are copper/tungsten, the putter head weighs 480 grams and the moment of inertia exceeds 12,000 gm cmÂ$^2$.

It will thus be seen that the objects set forth above, and those made apparent from the foregoing description, are efficiently attained.

Since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention that, as a matter of language, might be said to fall therebetween.

What is claimed is:

1. A golf putter head, comprising:

a main body having a generally triangular configuration;

said main body having a leading wall having a first breadth;

said leading wall having a top edge and a bottom edge;

said main body having a trailing wall having a second breadth less than said first breadth;

said trailing wall having a top edge and a bottom edge;

a first sidewall interconnecting a first end of said leading wall and a first end of said trailing wall;

a second sidewall interconnecting a second end of said leading wall and a second end of said trailing wall;

a soleplate extending between said leading wall and said trailing wall;

said soleplate having a breadth less than said second breadth of said trailing wall;

a cavity formed in said main body, said cavity bounded on four sides by said leading wall, said trailing wall, said first sidewall and said second sidewall;

said cavity being unbounded on a top end and being partially bounded on a lower end by said soleplate;

a ball-striking surface adapted to be mounted to said leading wall;

said soleplate being normal to said leading wall and said trailing wall;

a first weight-receiving cavity formed in said trailing wall;

a first weight means positioned within said first weight-receiving cavity;

a second weight-receiving cavity formed in said first sidewall;

a third weight-receiving cavity formed in said second sidewall;

a second weight disposed within said second weight-receiving cavity;

a third weight disposed within said third weight-receiving cavity;

whereby said trailing wall is spaced in trailing relation to said leading wall by a distance, and a center of gravity of said putter head is closer to said trailing wall than to said leading wall; and whereby said positioning of said center of gravity provides an enhanced moment of inertia to minimize the effects of a putt that misses a sweet spot on said ball-striking surface.

2. The golf head of claim 1, further comprising:

a web disposed in interconnecting relation between said leading wall and said trailing wall;

said web being disposed normal to said leading wall and said trailing wall;

said cavity being divided into two cavities by said web;

whereby said web transmits forces applied to said leading wall at least in part to said trailing wall;

whereby resistance offered by said leading wall to said applied forces is supplemented by resistance offered by said trailing wall.

3. The golf putter head of claim 2, further comprising:

said soleplate being centered on a longitudinal axis of symmetry of said golf putter head;

said web being mounted in upstanding relation to said soleplate;

said web being disposed on said longitudinal axis of said golf putter head and dividing said cavity into two cavities of equal size.

4. The golf putter head of claim 1, wherein said leading wall of said golf putter head is about four inches in breadth.

5. The golf putter head of claim 1, wherein the moment of inertia is in excess of six thousand grams centimeter squared (6,000 gm cm$^2$).

6. The golf putter head of claim 1, wherein said leading wall of said golf putter head is about four inches in breadth, wherein said golf putter head has a weight that does not exceed three hundred fifty grams (350 gm), and wherein the moment of inertia is in excess of six thousand grams centimeter squared (6,000 gm cm$^2$).

7. The golf putter head of claim 1, wherein said first, second, and third weight means are formed of copper/tungsten, wherein the total weight of said golf putter is about four hundred eighty grams, and wherein the moment of inertia of said golf putter head is at least 12,000 gm cm$^2$.

8. A golf putter head, comprising:

a main body having a generally triangular configuration;

said main body having a leading wall havig a first breadth;

said leading wall having a top edge and a bottom edge;

said main body having a trailing wall having a second breadth less than said first breath;

said trailing wall having a top edge and a bottom edge;

a first sidewall interconnecting a first end of said leading wall and a first end of said trailing wall;

a second sidewall interconnecting a second end of said leading wall and a second end of said trailing wall;

a soleplate extending between said leading wall and said trailing wall;

said soleplate having a breadth less than said second breadth of said trailing wall;

a cavity formed in said main body, said cavity bounded on four sides by said leading wall, said trailing wall, said first sidewall and said second sidewall;

said cavity being unbounded on a top end and being partially bounded on a lower end by said soleplate;

said soleplate being normal to said leading wall and said trailing wall; a first weight-receiving cavity formed in said trailing wall;

a first weight means positioned within said first weight-receiving cavity; a second weight-receiving cavity formed in said first sidewall;

a third weight-receiving cavity formed in said second sidewall;

a second weight disposed within said second weight-receiving cavity;

a third weight disposed within said third weight-receiving cavity;

said trailing wall is spaced in trailing relation to said leading wall by a distance; and the putter head possesses a center of gravity providing an enhanced moment of inertia.

9. The golf putter head of claim 8, wherein said leading wall of said golf putter head is about four inches in breath.

10. The golf putter head of claim 8, wherein the golf putter head has a weight that does not exceed three hundred fifty grams (350 gm).

11. The golf putter head of claim 8, wherein the golf putter head possesses a moment of inertia in excess of six thousand grams centimeter squared (6,000 gm $cm^2$).

12. The golf putter head of claim 8, wherein the second and third weight-receiving cavities both open to one surface of the putter head, and the first weight-receiving cavity opens to an opposite surface of the putter head.

13. The golf putter head of claim 12, wherein the first weight-receiving cavity opens to a bottom surface of the putter head, and the second and third weight-receiving cavities opens to a top surface of the putter head.

14. The golf putter head of claim 8, wherein the second and third weight-receiving cavities are located closer to said leading wall than said trailing wall.

15. A golf putter head, comprising:

a main body having a generally triangular configuration;

said main body having a leading wall having a first breadth;

said leading wall having a top edge and a bottom edge;

said main body having a trailing wall having a second breadth less than said first breadth, said trailing wall being spaced from said leading wall by a distance;

said trailing wall having a top edge and a bottom edge;

a first sidewall interconnecting a first end of said leading wall and a first end of said trailing wall;

a second sidewall interconnecting a second end of said leading wall and a second end of said trailing wall;

a soleplate extending between said leading wall and said trailing wall;

a web positioned between said leading wall and said trailing wall, said web having a top edge;

said web being disposed normal to said leading wall;

a first cavity formed in said main body on a first side of said web;

said first cavity being bounded on four sides by said first sidewall, said web, at least a portion of leading wall, and at least a portion of said trailing wall;

a second cavity formed in said main body on a second side of said web that is opposite the first side of said web;

said second cavity being bounded on four sides by said second sidewall, said web, at least a portion of said leading wall, and at least a portion of said trailing wall;

said cavity being unbounded on a top end and being partially bounded on a lower end by said soleplate;

said soleplate being normal to said leading wall and said trailing wall;

a first weight-receiving cavity formed in said trailing wall;

a first weight means positioned within said first weight-receiving cavity;

a second weight-receiving cavity formed in said first sidewall;

a third weight-receiving cavity formed in said second sidewall;

a second weight disposed within said second weight-receiving cavity;

a third weight disposed within said third weight-receiving cavity.

16. The golf putter head of claim 15, including a groove extending along the entire top edge of the web to provide a sighting line for a user.

17. The golf putter head of claim 15, wherein the golf putter head has a weight that does not exceed three hundred fifty grams (350 gm).

18. The golf putter head of claim 17, wherein the golf putter head possesses a moment of inertia of at least 5860 gm $cm^{2.}$

19. The golf putter head of claim 15, wherein the second and third weight-receiving cavities both open to one surface of the putter head, and the first weight-receiving cavity opens to an opposite surface of the putter head.

20. The golf putter head of claim 19, wherein the first weight-receiving cavity opens to a bottom surface of the putter head, and the second and third weight-receiving cavities opens to a top surface of the putter head.

21. The golf putter head of claim 15, wherein the second and third weight-receiving cavities are located closer to said leading wall than said trailing wall.

* * * * *